United States Patent [19]

Alvarez

[11] Patent Number: 4,701,150

[45] Date of Patent: Oct. 20, 1987

[54] TOY AUTOMOBILE AND FILLING STATION SET

[76] Inventor: Jorge A. Alvarez, 1230 S. Kern Ave., Los Angeles, Calif. 90022

[21] Appl. No.: 780,028

[22] Filed: Sep. 25, 1985

[51] Int. Cl.[4] ..... A63H 17/44; A63H 29/22

[52] U.S. Cl. ..... 446/423; 446/431; 446/462; 446/433; 272/8 R

[58] Field of Search ..... 272/8 R, 8 N; 446/431, 446/457, 462, 484, 423, 475, 478, 483

[56] References Cited

U.S. PATENT DOCUMENTS

| | | | |
|---|---|---|---|
| 917,459 | 4/1909 | Kroenung | 446/483 X |
| 2,040,521 | 5/1936 | Marx | 446/423 |
| 2,298,431 | 10/1942 | Sullivan et al. | 446/431 |
| 3,061,970 | 11/1962 | Knott | 272/8 R X |
| 4,347,683 | 9/1982 | Maxim | 446/462 X |
| 4,476,648 | 10/1984 | Maxim | 446/462 X |

*Primary Examiner*—Richard T. Stouffer
*Attorney, Agent, or Firm*—Paul H. Gallagher

[57] ABSTRACT

A toy automobile and a toy filling station forming a set. The automobile has a self contained power plant, including a battery and a motor. To drive the automobile, water is introduced into a container in the automobile, simulating gasoline fuel, which causes an expandable member to expand which closes a switch to energize the motor. The automobile also includes a quantity of black powder that the water mixes with and produces a black liquid that simulates lubricating oil. The filling station includes a tank of water for introducing into the automobile. The filling station also includes an air pump for pressuring the water in the tank. The air pump also serves as a standard for simulating an advertising display.

2 Claims, 5 Drawing Figures

TOY AUTOMOBILE AND FILLING STATION SET

FIELD OF THE INVENTION

The invention resides in the field of toys, but more particularly in the field of toy automobiles that simulate actual automobiles, utilizing simulated filling stations, and simulated fuel tanks and providing simulated fuel.

OBJECTS OF THE INVENTION

A broad object of the invention is to provide toy automobiles having simulated features of actual automobiles, such as the following:

1. Filling stations are provided, providing the appearance and overall atmosphere surrounding actual automobiles and their function.

2. A simulated fuel, water, is introduced into the toy automobiles in the filling stations, in a manner similar to that of introducing gasoline in actual automobiles.

3. A supply of material is carried in the toy automobile and used in conjunction with the water, for initiating movement of the toy vehicle.

4. A pumping action is used at the filling stations for introducing the water into the toy automobiles, for simulating attention given by the driver of an actual automobile to render the procedure more real in a child's mind.

DESCRIPTION OF A PREFERRED EMBODIMENT

The invention involves a toy device, and includes a toy automobile, and a toy filling station, together constituting a set. The two parts are separate, the automobile being movable under its own power, and the filling station normally remaining stationary in the use thereof, although it can be moved from one place to another.

Figure 1:
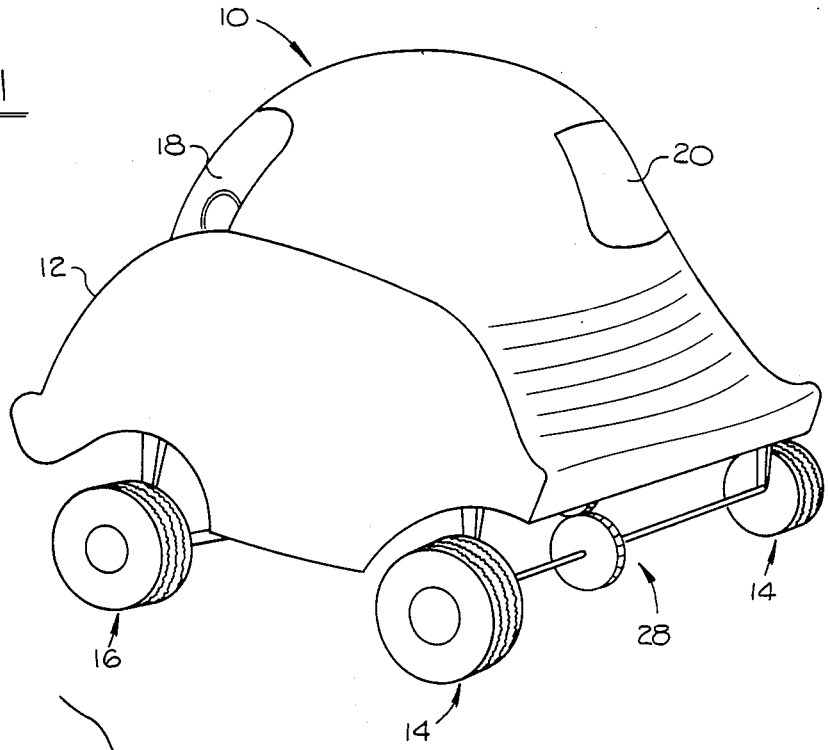
FIG. 1 is a perspective view of a toy automobile of the invention.

The toy automobile is shown in its entirety at 10, in FIG. 1. This figure shows only the exterior of the automobile, the automobile having a body 12, rear wheels 14 and front wheels 16. The body also is provided with a windshield 18 and a rear window 20 to simulate an actual automobile.

Figure 3:
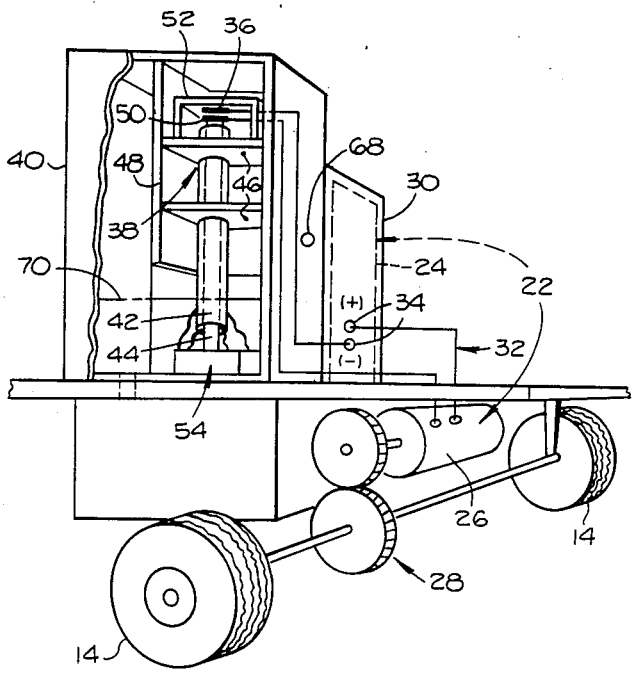
FIG. 3 is a perspective view of certain internal components of the toy automobile.

FIG. 3 shows certain of the internal components of the toy automobile, isolated from the body thereof. The automobile includes a self-contained power plant for driving it under the control of various steps, including the use of simulated fuel. The self-contained power plant is indicated in its entirety at 22, and includes a battery 24 and an electric motor 26. The simulated fuel to be used in the vehicle is water, which performs an expanding function and thereby closing a switch in the circuit.

Interposed between the motor 26 and the rear wheels 14 is a drive train 28 of suitable form, for driving the automobile as controlled as described hereinbelow.

The battery 24, of the self-contained power plant is a complete operating battery, capable of being charged, and holding the charge, and when connected in circuit, is operable for driving the wheels. The battery 24 may be suitably housed as in a container or box 30 within the automobile.

An electrical circuit is indicated at 32 having conductors connected with the positive and negative terminals 34 of the battery. The circuit includes a switch 36, contained within the automobile as referred to below, and controllably actuated for energizing the battery and driving the vehicle.

The switch 36 is incorporated in a control component indicated in its entirety at 38, which is positioned within a container or box 40 mounted within the body of the vehicle. The container or box 40 is water-tight, being used for holding water that is used as the simulated fuel, this container being made of any suitable material. The control unit 38 includes an outer sleeve 42 and an inner rod or plunger 44 slidable therein, within a limited range. The sleeve is mounted in a pair of mounting elements 46 which may be in the form of shelves, and secured therein in water-tight relation, such as by welding. These elements 46 are contained within another container 48 which is also water-tight.

The upper end of the rod 44 is provided with a contacter 50 engageable with the switch 36 for closing the latter when it so engages it, in a manner referred to hereinbelow. The switch 36 may be mounted in a suitable holder or framework 52 mounted on the upper element 46 and within the container 48.

Figure 5:
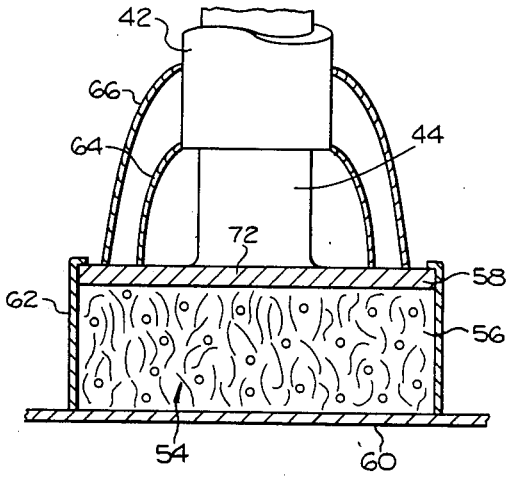
FIG. 5 is a sectional view of a portion of the lateral operating components, shown in FIG. 3.

Disposed below the element 38 is an expansible component 54 and attention is directed to FIG. 5 for the details thereof. This component 54 includes an element 56 of suitable kind that expands upon being wetted, such as by water. There are many such kinds of materials known. This material 56 is disposed under, and may be secured to, a plate 58. The material 56 rests on a bottom element 60 which constitutes the bottom element of the container 40. The plate 58 is movable vertically in response to expansion and contraction of the material 56, and is suitably mounted and held in position such as by corner angle irons 62 in which the plate 58 slides.

The component 38 is sealed from the water that is utilized in the device, by a pair of bell-shape casings 64, 66 which may be flexible skirts of suitable kind secured and sealed to the outer sleeve 42 and the plate 58. The casing 40 is provided with a hole 68 (FIG. 3) for introduction of water thereinto. The water is so introduced to a suitable level such as indicated at 70, and it comes in direct contact with the expansible member 56, and expands the latter, moving the plate 58 upwardly. The rod 44 is secured to the plate, and may be welded thereto as indicated at 72, and as the plate is moved upwardly, the rod 44 is also moved upwardly, bringing the contactor 50 into contact with the switch 36 and closing the latter. This closes the circuit 32 and drives automobile.

Figure 2:
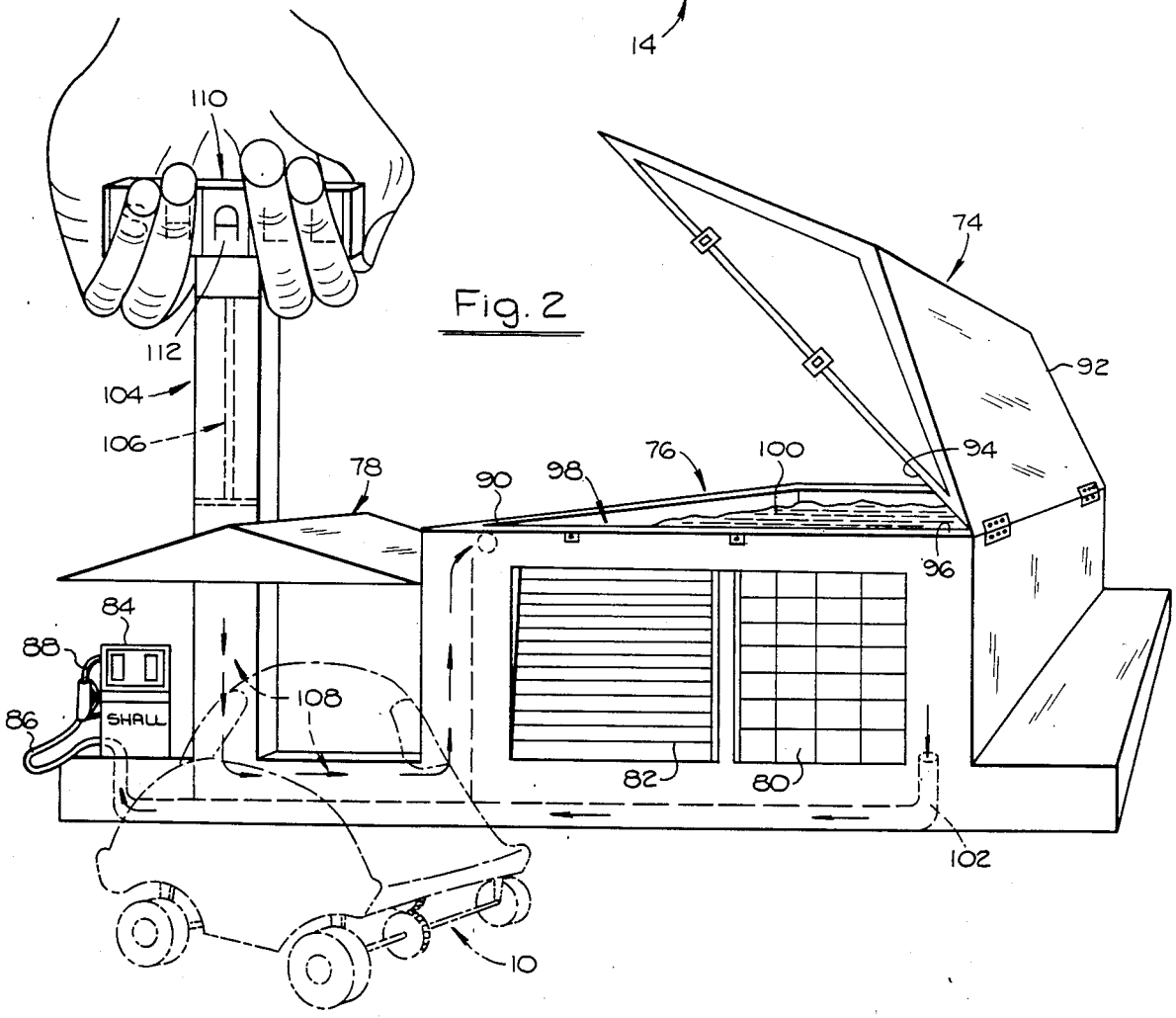
FIG. 2 is a perspective view of a toy filling station, and showing in dot-dash lines a toy automobile according to FIG. 1.

The simulated filling station shown in FIG. 2 and referred to above is indicated specifically by the numeral 74. This simulated filling station includes a main part 76 in the shape of a building, and a second part 78 which may be merely a roof or other feature. The overall effect of the simulated filling station is to make it appear as much as possible as an actual filling station, and the part 76 may have additional features such as apparent windows, doors 80, 82 to give that impression. Also there is an apparent fuel pump 84 and a fuel hose 86 with a faucet 88.

The part 76 of the simulated filling station, has a lower portion 90 open at the top, and closed by a hinged member 92 forming a simulated roof. The lower portion and the roof have interengaging sealing surfaces 94, 96 to seal the interior in air-tight relation, and the bottom portion has an interior space 98 forming a tank for a supply of water 100.

The building 74 has a water line or channel 102 leading from the tank to the hose 86 for carrying water therethrough to the toy automobile as will be referred to again hereinbelow.

The filling station of FIG. 2 also includes an air pump 104. This air pump can be manually actuated, by a child, having a pumping component 106 of known kind, and upon actuation thereof forces air downwardly through an air conduit 108 into the tank 98. The pump 104 has a handle 110 which preferably stands above the remainder of the filling station, and may bear advertising material 112 which can be seen broadside over and beyond the remainder of the unit.

FIG. 2 shows the toy automobile 10 in dot-dash lines, in association with the simulated filling station.

In the use of the device, the user, the child, places the toy automobile in the position shown in FIG. 2, and introduces the simulated fuel into the automobile. This is normally done by actuating the pump 104 and developing air pressure in the tank 98. This forces the water out through the channel 102 and through the hose 86 and faucet 88 into the automobile, which as indicated above, is through the hole 68 (FIG. 3). The water then flows into the container 40 as referred to above. Upon this taking place, the material 56 expands, forcing the rod 44 upwardly and closing the switch 36, producing the driving action referred to.

Figure 4:
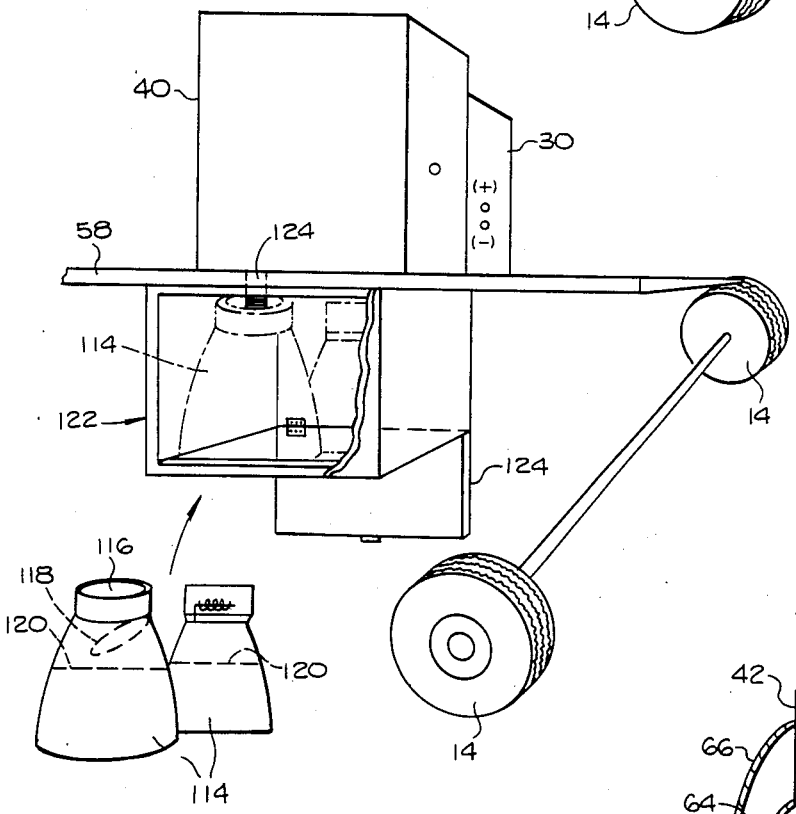
FIG. 4 is a perspective view of certain other internal components of the toy automobile, with various elements shown in position removed from the automobile.

Another feature of the arrangement is simulated lubricating oil. FIG. 4 shows a pair of bottles or containers 114 which may be of suitable shape and size, and may be flexible bags, or rigid containers. Each has a filling opening 116 at the top, and includes a closing valve 118 for closing the opening.

Disposed in these bottles 114 is a quantity of material 120 which may be a suitable black powder of known kind. These bottles are placed in a container or box 122 in the interior of the automobile, such as on the underside of, and supported by, the bottom plate 58. A pipe 124 is provided in the bottom plate 58 and conducts water from the upper container 40 downwardly into one of the bottles 120 associated therewith. The water in the bottle, upon mixing with the powder, produces a liquid, which is black, and the child in playing with the toy, empties the container with the apparent effect of pouring out used lubricating oil. Only a small amount of powder is used, the size of the bottles being morely indicative.

The container 122 may be of any suitable specific construction, and may include a bottom door 124 for placing the bottles 114 in the container 122, and removing them therefrom.

I claim:

1. A toy automobile and toy filling station set comprising, the automobile having a self-contained motor and power means for driving it, control means for activating the power means, a tank for holding water, actuating means responsive to water in the tank for actuating the control means, the filling station including a simulated gasoline pump, a simulated building having space therein including a water tank, and a roof movable between an open position exposing the water tank in the building and a closed position covering the water tank and sealable with the remainder of the filling station for sealing the water tank therein, conduit means for conducting water from the water tank in the building through the simulated gasoline pump into the tank in the automobile, and a manually operatable air pump for pumping air into said space for forcing water in the water tank therein into the tank in the automobile, said air pump including a vertically standing and vertically movable actuating member including a hand gripping element at the top thereof, said element connected to said actuating member for moving said actuating member with respect to the remainder of said air pump, the actuating member of the air pump extending above the remainder of the filling station including above the gasoline pump and the remainder of the air pump, and the hand gripping element including display material viewable broadside over the remainder of the filling station.

2. A toy automobile and toy filling station set according to claim 1 wherein, the actuating means in the automobile includes means expansible and operable in response to water in the tank of the automobile to activate the actuating means, the automobile includes a container for containing coloring material therein, said container being arranged for entrance thereinto of water from the tank in the automobile, when water and coloring material are in the container, the coloring material coloring the water in the container for producing simulated lubricating oil, and the container being removable from the automobile for enabling emptying the container, and replaceable again therein, the container having means normally closing it but opened downwardly in response to placement of the container in the automobile.

* * * * *